US006870297B1

(12) United States Patent
Käsdorf

(10) Patent No.: US 6,870,297 B1
(45) Date of Patent: Mar. 22, 2005

(54) HOLDING DEVICE FOR A CARBON BRUSH

(75) Inventor: Wolfgang Käsdorf, Aarbergen (DE)

(73) Assignee: K-Tech GmbH, Schmitten (DE)

( * ) Notice: Subject to any disclaimer, the term of this patent is extended or adjusted under 35 U.S.C. 154(b) by 0 days.

(21) Appl. No.: 10/450,522

(22) PCT Filed: Dec. 18, 2001

(86) PCT No.: PCT/EP01/14932

§ 371 (c)(1),
(2), (4) Date: Sep. 16, 2003

(87) PCT Pub. No.: WO02/50963

PCT Pub. Date: Jun. 27, 2002

(30) Foreign Application Priority Data

Dec. 19, 2000 (DE) ..... 100 63 405

(51) Int. Cl.[7] ..... H01R 39/39
(52) U.S. Cl. ..... 310/239
(58) Field of Search ..... 310/239

(56) References Cited

U.S. PATENT DOCUMENTS 4,431,933 A * 2/1984 Mabuchi ..... 310/239
4,574,215 A * 3/1986 Mabuchi ..... 310/239
4,638,203 A 1/1987 Maki et al.
4,746,829 A * 5/1988 Strobl ..... 310/239
5,175,464 A * 12/1992 Smith ..... 310/239
6,300,696 B1 * 10/2001 Wong ..... 310/68 R

FOREIGN PATENT DOCUMENTS

DE 2413578 10/1975

* cited by examiner

*Primary Examiner*—Joseph Waks
(74) *Attorney, Agent, or Firm*—Dennison, Schultz, Dougherty & MacDonald

(57) ABSTRACT

Holding device for a carbon brush especially connected to a commutator or a friction ring with a front end including a bent spring element with a U- or L-shaped bent holding device segment and a carrier segment for receiving the carbon brush. In order to fix the brush securely without a notch effect, the carrier segment includes a support surface supporting the carbon brush on its rear side, and holding segments protruding from the carrier segment and extending along at least two opposing lateral surfaces of the carbon brush.

8 Claims, 3 Drawing Sheets

HOLDING DEVICE FOR A CARBON BRUSH

BACKGROUND OF THE INVENTION

The invention concerns a holding device for a carbon brush that is especially connected to an end face at a commutator or a friction ring comprising a bent spring element with a U- or L-shaped holding device segment and a carrier segment for the carbon brush equipped with a support surface facing the posterior side of the carbon brush as well as along the side surfaces, especially two carrier segments along two opposite side surfaces or edges of the carbon brush.

An appropriate holding device can be seen in U.S. Pat. No. 4,638,203. The holding device consists of a L-shaped spring element, whose one leg has a U-shaped recess where the carbon brush is mounted.

According to DE 199 62 705 A1, the carrier segment has a perforation where the carbon brush is located in order to secure the brush via a cutting clamp. As the carbon brush stretches in segments on the backside along the carrier segment, a minimum mounting depth is required that can lead to serious problems, especially with small engines. In addition, a notch effect is created through the cutting clamp connection when vibrations take place. As the posterior side of the carbon brush penetrating the carrier segment often has a smaller cross section than the segment facing the commutator where the carbon brush is located for the current transfer it is required by the manufacture that the carbon brush material is pressed longitudinally at the carbon brush to be manufactured.

An electrical motor for small engines according to DE 24 13 578 A1 has holding devices in the form of laminated springs for carbon brushes that have a prismatic projection each that can be fastened through the notch effect in a cutout of the laminated springs.

SUMMARY OF THE INVENTION

The present invention is based on the problem to develop the holding device of the above described type further, making a safe fastening of the carbon brush without notch effect possible whereby the mounting space would be minimized. An optimal utilization of the carbon brush should also be possible.

The problem is essentially solved according to the invention by cutting free a segment from the carrier segment and bending a segment from the locked surface of the carrier segment.

According to the invention, the carbon brush surface is supported by the carrier segment preventing the carbon brush from protruding from the backside of the carrier segment. Consequently, the mounting space is only dependent on the effective interacting length of the carbon brush with the commutator or the friction ring. In addition, the carbon brush can be fastened with a cutting clamp connection, preventing the negative notch effects caused by vibrations. The holding device segment continues to run on the level of the carrier segment so that no enlargement of the mounting space is required. At the same time, a high level of stability is given.

An especially safe fastening occurs without danger of uncontrolled sliding if two holding device segments stretch along the side surfaces of the carbon brush like flags. The carbon brush can be mounted via clamps at the holding device segment.

The carbon brush can either be a block carbon brush or a hammer carbon brush.

As the cross-section of the carbon brush remains the same based on the holding device according to the invention, and therefore, the fixation of the carbon brush also remains the same in the posterior area, the advantage arises that a preferred direction for the pressing of the carbon brush material need not be followed. It is, therefore, possible to use carbon brushes that have been pressed vertically or parallel to the longitudinal axis of the finish carbon brush.

BRIEF DESCRIPTION OF THE DRAWINGS

Additional details, advantages, and characteristics of the invention result not only from the claims and the characteristics arising from them, individually or in combination, but also from the following description of the preferred design drawings.

They show.

DESCRIPTION OF THE PREFERRED EMBODIMENT

Figure 5:
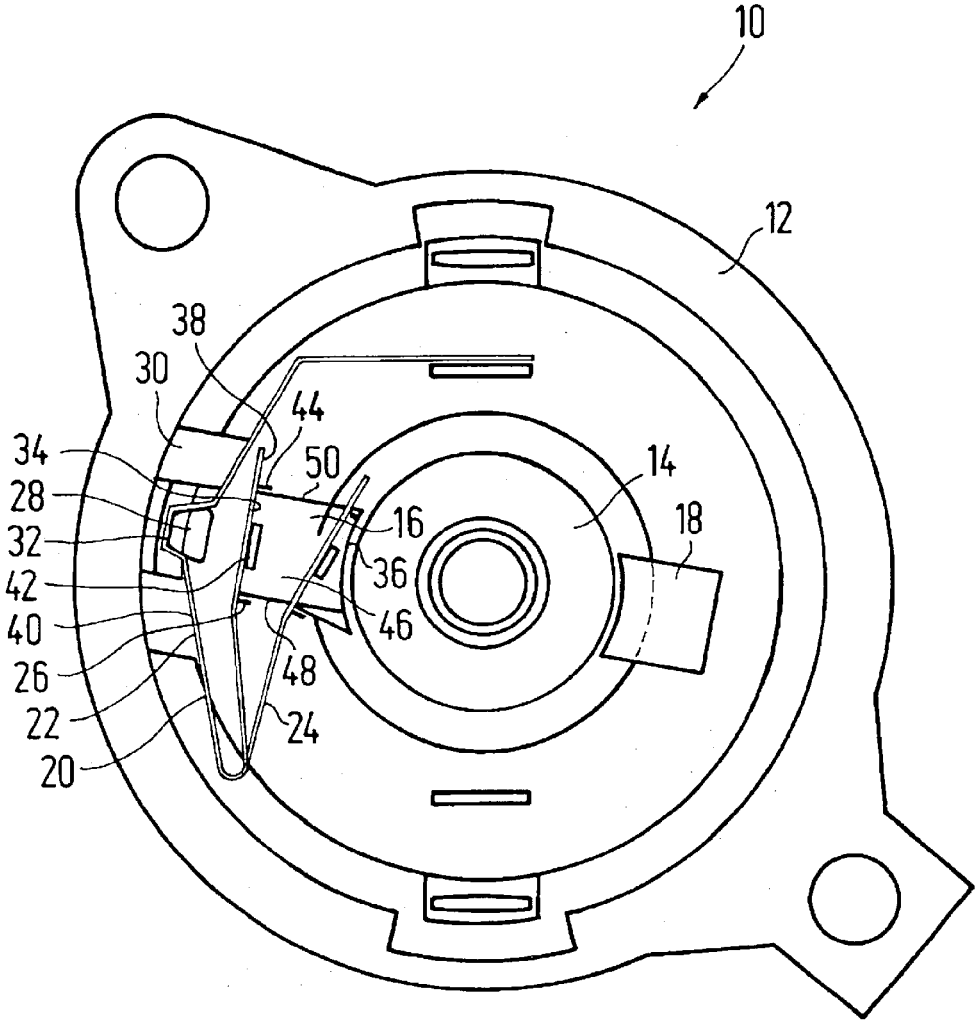
FIG. 5 a principal presentation with a of a carbon 4 brush mounted on a small engine.

A small engine 10 with engine housing 12 and the electric motor with commutator 14 is shown in FIG. 5 purely in principal, where the carbon brushes 16, 18 are electrically charged. Hereby, the carbon brushes 16, 18 extend from holding device 20 which is drawn purely in principal in connection with the carbon brush 16 in the form of a laminated spring whose function is known, comprising a holding device leg or holding device segment 22 and a carrier segment 24 holding the carbon brush 16. The holding device segment 22 is fastened in a known method between bearings and counter bearings 26, 28, and 30. Here, the holding device segment 22 is equipped with a U-shaped bent segment 32, which surrounds the bearing 28 whereby the bordering segments lie flat against the counter bearings 26, 30. Thus, the holding device 20 is clearly fastened whereby, based on the bias of the carrier segment 24 opposite the holding device segment 22, the carbon brush 16 extending from the carrier segment 24 receives the necessary electrical charge in the direction of the commutator 14.

The carbon brush 16 lies with its posterior surface 34, which extends levelly opposite the end face 36 along the commutator 14, flat on the side 38 facing the carrier segment 24 and is fastened via the carrier segment 24 or the surface of the freely-cut and outwardly bent laps or flags 40, 42, 44, whereby at least one lap or one flag 40, 42, 44 runs along the side surface 46, 48, 50 of the carbon brush 16. Hereby, the carbon brush 16 is guided to the required extent and secured by clamps, if necessary, without the cutting clamp and its notch effect, as is the case in the state-of-the-art.

A preferred design of fixture 52 that can be seen from FIGS. 1–4, corresponding to the principal structure of holding device 20, consists of a carrier segment 54 and a U-form bent holding segment 56, whereby its free leg 58 is equipped with segment 59 which has an outwardly bent diverging leg that is surrounded by a bearing according to bearing 28, shown in FIG. 5, for the securing of the carbon brush bracket 52.

Figure 3:
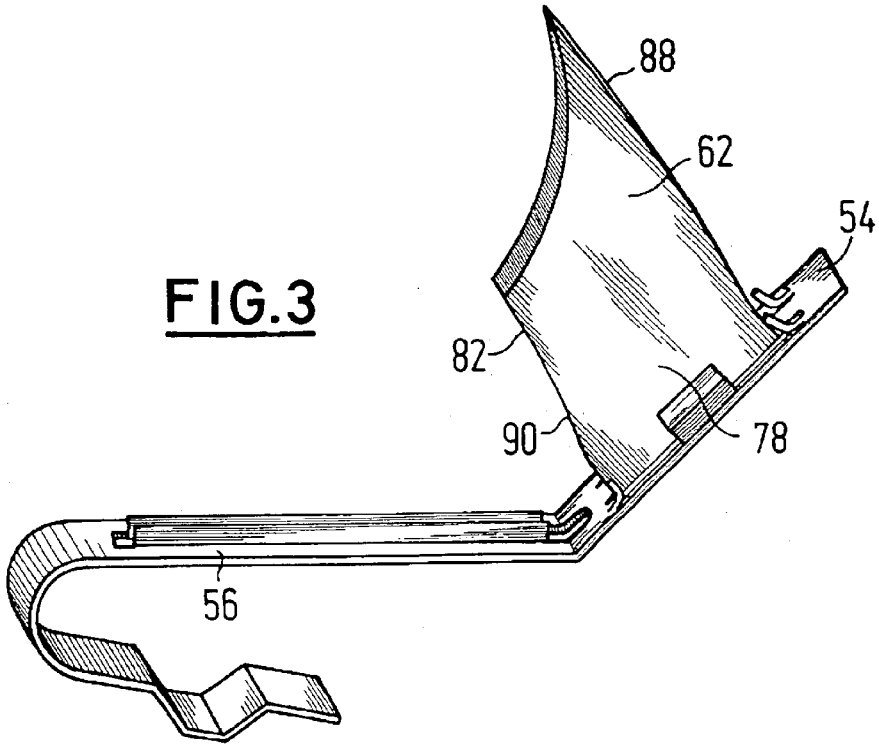
FIG. 3 the carbon brush holding device according to FIGS. 1 and 2, with the carbon brush.
Figure 4:
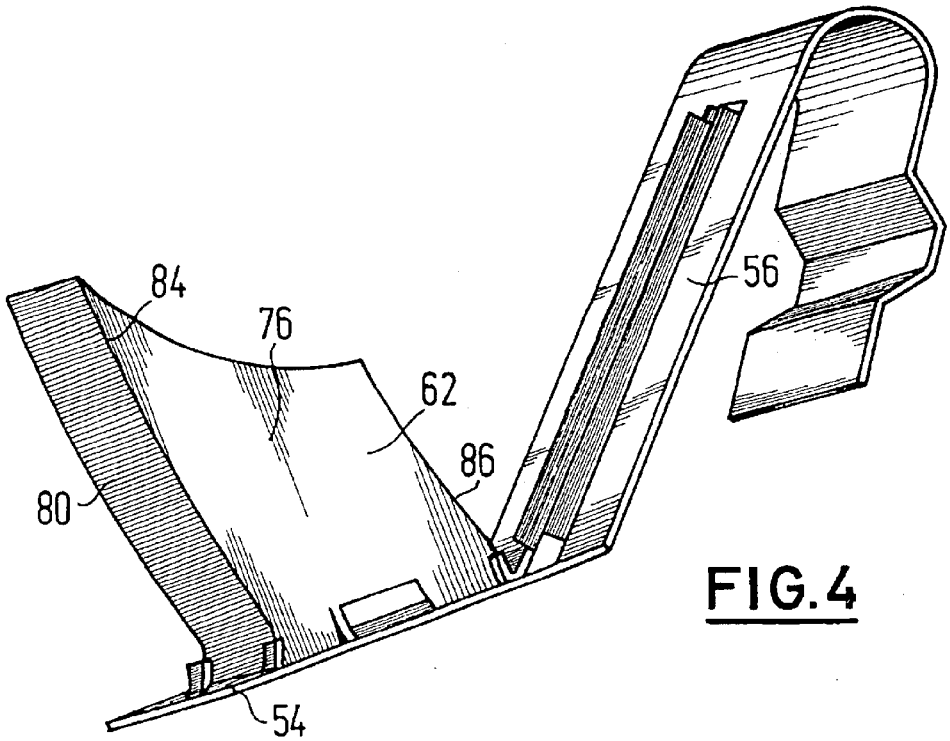
FIG. 4 the holding device depicted in FIG. 3 with a carbon brush in a different perspective presentation.

The carrier segment 54 is equipped with a freely cut surface 60 on which a carbon brush lies flat on the posterior surface, as can be seen in the carbon brush 62 in FIGS. 3 and 4. To fasten the carbon brush 62, the holding device segments 64, 66, 68, 70, 72, 74, are freely cut and bent from the surface 60 so that the fastened carbon brush 62 can extend along the outer side surfaces 76, 78, 80, 82 and can, if necessary, hold the carbon brush 62 with clamps.

The fastening with clamps is no compelling characteristic as the surface holding device segments or the flags 64, 66, 68, 70, 72 74 have to offer the axial guidance in the true sense by themselves which is power charged on a commutator based on the spring effect of the carrier segment 54. Therefore, if the carbon brush is correctly placed, only the guidance in horizontal direction is necessary without necessity of any additional clamps.

Figure 1:
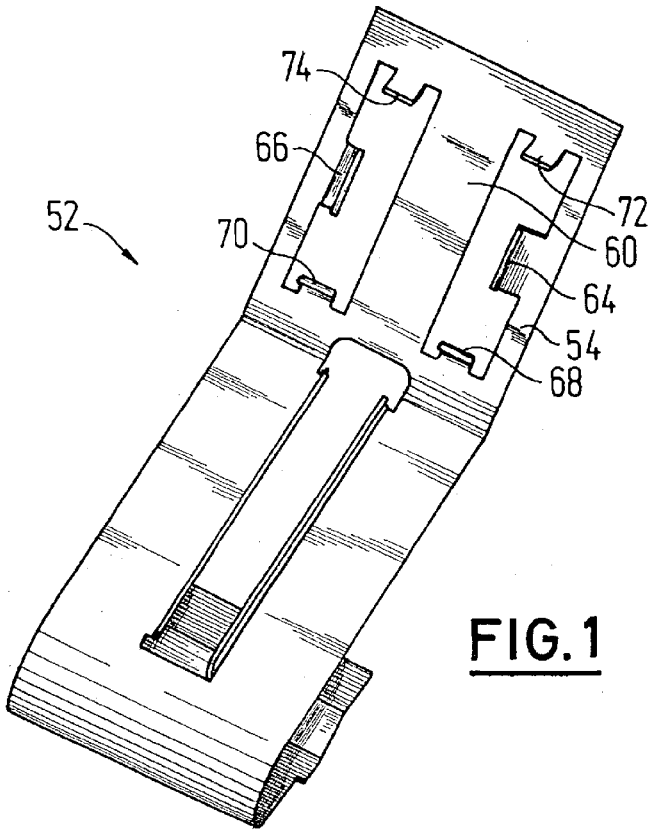
FIG. 1 in a perspective presentation, a top view of the carbon brush holding device.
Figure 2:
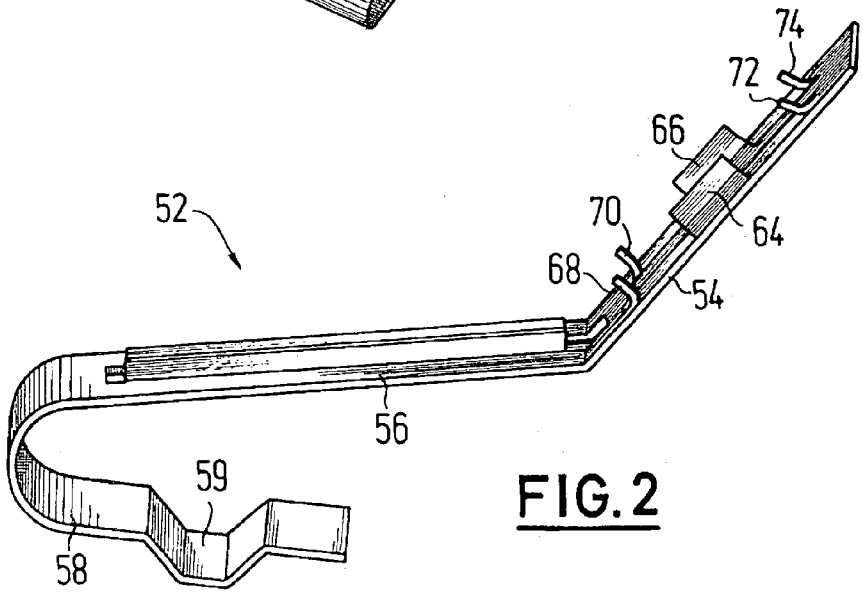
FIG. 2 in a perspective presentation, a side view of the carbon brush holding device according to FIG. 1.

As can be seen especially in FIGS. 1 and 2, the carbon brush 62 is held by the holding device and two holding device segments or flags 68, 70 or 72, 74 along the narrow sides 80, 62 and the holding device segment or holding device flag 64, 66 along the broad sides that are broader than the ones running along the narrow sides 80, 62. A holding device flag 68, 70, 72, 74 stretches from each longitudinal edge 84, 86, 88, 90 of the carbon brush 62, whereby the flags 64, 66 stretching along the remaining longitudinal surfaces 76, 78 of the carbon brush 62 are guided axially in such a way that no turning can take place.

As the carbon brush 62 lies flat on the level locked in by carrier segment 54, which is carrier surface 60, a clear bordering of the carbon brush to the commutator is guaranteed, even when vibrations occur. As the carbon brush 62 does not penetrate the carrier segment 54, only a small mounting depth is necessary.

Especially in the use of block carbon brushes there is the advantage that the press-ready mixture that is necessary for the manufacture of the carbon brush can be pressed in the desired direction in relation to the longitudinal axis of the carbon brush, meaning, for example, parallel to the longitudinal direction of the finished carbon brush or vertical to it. Herein additional especially highlighted characteristics can be found.

It should be noted that the segments or flags cut out of carrier segment and bent from the surface can be run in such a way that at least some abut at a line, e.g. to diagonally opposite edges 84, 90 or 86, 88 of the carbon brush 62.

What is claimed is:

1. Holding device having a carbon brush retained therein, the holding device comprising a spring element segment having a U- of L-shaped bend therein and a carrier segment in which the carbon brush is retained, an end of the spring element segment being connected to an end of the carrier segment, the carrier segment comprising a support area for the carbon brush including holding segments cut free from the carrier segment and bent outwardly from a plane defined by the carrier segment, wherein the carbon brush comprises a substantially planar rear surface which lies flat against the support area of the carrier segment without protruding therethrough, with the holding segments extending along side surfaces or edges of the carbon brush.

2. Holding device according to claim 1, wherein at least one protruding holding segment stretches along each side surface of the carbon brush from the carrier segment of the holding device.

3. Holding device according to claim 1, wherein two holding segments each stretch along narrow sides of the carbon brush and along broad sides of the carbon brush to the holding segment.

4. Holding device according to claim 1, wherein at least one holding segment runs along each edge of the carbon brush.

5. Holding device according to claim 1, wherein the holding segments secure the carbon brush with clamps.

6. Holding device according to claim 1, wherein the carbon brush is either a block carbon brush or a hammer carbon brush.

7. Holding device constructed and arranged for having a carbon brush with a substantially planar rear surface retained therein, the holding device comprising a spring element segment having a U- of L-shaped bend therein and a carrier segment constructed and arranged to retain the carbon brush, an end of the spring element segment being connected to an end of the carrier segment, the carrier segment comprising a support area for the carbon brush including holding segments cut free from the carrier segment and bent outwardly from a plane defined by the carrier segment, wherein the support area of the carrier segment is constructed and arranged to receive the substantially planar rear surface of the carbon brush lying flat thereagainst, without protruding therethrough, with the holding segments extending along side surfaces or edges of the carbon brush.

8. Holding device according to claim 7, wherein the holding segments extend along sides of a rectangle, with two holding segments extending along shorter sides of the rectangle, and two holding segments extending along longer sides of the rectangle.

* * * * *

UNITED STATES PATENT AND TRADEMARK OFFICE

CERTIFICATE OF CORRECTION

PATENT NO. : 6,870,297 B1
DATED : March 22, 2005
INVENTOR(S) : Wolfgang Kasdorf

It is certified that error appears in the above-identified patent and that said Letters Patent is hereby corrected as shown below:

Title page,
Item [73], Assignee, should read -- K-Tec GmbH, Schmitten (DE) --.

Signed and Sealed this

Twenty-first Day of March, 2006

JON W. DUDAS
*Director of the United States Patent and Trademark Office*